US008585988B2

(12) United States Patent
Nietfeld

(10) Patent No.: US 8,585,988 B2
(45) Date of Patent: Nov. 19, 2013

(54) METHOD FOR CREATING TRACEABLE TISSUE SAMPLE CASSETTES WITH RFID TECHNOLOGY

(75) Inventor: Jan Jaap Nietfeld, Maarssen (NL)

(73) Assignee: Intresco B.V., Maarssen (NL)

( * ) Notice: Subject to any disclaimer, the term of this patent is extended or adjusted under 35 U.S.C. 154(b) by 0 days.

(21) Appl. No.: 13/376,351

(22) PCT Filed: Jun. 4, 2010

(86) PCT No.: PCT/NL2010/000092
§ 371 (c)(1),
(2), (4) Date: Mar. 5, 2012

(87) PCT Pub. No.: WO2010/140879
PCT Pub. Date: Dec. 9, 2010

(65) Prior Publication Data

US 2012/0144657 A1 Jun. 14, 2012

(30) Foreign Application Priority Data

Jun. 4, 2009 (NL) ..... 2002967

(51) Int. Cl.
*B01L 3/00* (2006.01)

(52) U.S. Cl.
USPC ..... 422/554; 422/82.01; 29/600; 340/572.7

(58) Field of Classification Search
USPC ..... 29/592.1, 830–834, 846–847, 600–601; 340/572.1–572.7; 422/554, 82.01, 422/500–503, 518; 435/288.3–288.7
See application file for complete search history.

(56) References Cited

U.S. PATENT DOCUMENTS

| | | | | |
|---|---|---|---|---|
| 7,382,258 | B2 * | 6/2008 | Oldham et al. | 340/572.1 |
| 7,999,677 | B2 * | 8/2011 | Azuma | 340/572.1 |
| 8,028,923 | B2 * | 10/2011 | Shafran et al. | 235/492 |
| 8,163,252 | B2 * | 4/2012 | Booker et al. | 422/400 |
| 8,199,016 | B2 * | 6/2012 | Forster et al. | 340/572.7 |
| 8,231,846 | B2 * | 7/2012 | Hughes | 422/554 |
| 8,329,120 | B2 * | 12/2012 | Williamson et al. | 422/536 |
| 2002/0030598 | A1 * | 3/2002 | Dombrowski et al. | 340/572.1 |
| 2005/0242957 | A1 * | 11/2005 | Lindsay et al. | 340/572.7 |
| 2006/0199196 | A1 | 9/2006 | O'Banion et al. | |
| 2006/0239867 | A1 * | 10/2006 | Schaeffer | 422/102 |
| 2008/0068176 | A1 | 3/2008 | Azuma et al. | |

FOREIGN PATENT DOCUMENTS

| | | |
|---|---|---|
| GB | 2 279 739 A | 3/2003 |
| GB | 2 446 604 A | 8/2008 |

* cited by examiner

*Primary Examiner* — Minh Trinh
(74) *Attorney, Agent, or Firm* — Wood, Phillips, Katz, Clark & Mortimer

(57) ABSTRACT

The present invention relates to a method to turn cassettes for biological tissue samples into devices traceable with RFID technology, using a system with inlays tagged with an RFID chip, which inlays are placed in the tissue sample chamber of the tissue cassettes, wherein the part of the inlay that contains the antenna of the RFID chip is running around an opening or is folded together. Such inlays do not risk being affected by damaging forces outside the tissue cassettes. With an inlay that at every suitable moment can be positioned in the tissue sample chamber for one or more limited periods of time, or indefinitely, tissue cassettes can be tracked and traced with RFID technology without the fear of destroying the RFID chip during processing that involves the use of a microwave oven. During that period the inlay can be temporarily removed from the tissue cassette.

13 Claims, 4 Drawing Sheets

METHOD FOR CREATING TRACEABLE TISSUE SAMPLE CASSETTES WITH RFID TECHNOLOGY

BACKGROUND OF THE INVENTION

Devices which are typically referred to as Radio Frequency Identification (RFID) tags or RFID chips, are made possible by technologies like described in U.S. Pat. No. 3,713,148 and U.S. Pat. No. 4,384,288. These patents are hereby incorporated by reference. Numerous applications for RFID tags are known to those skilled in the art, e.g. product labeling and supply chain management in retail, applications in road toll systems, public transport systems, passports, long distance running, and tagging of animals and library books.

RFID tags can be divided in those with a passive RFID chip and those with an active RFID chip. The passive RFID chips are dependent for the electrical energy to function on the wireless signal from a reader or interrogator device. When the signal transmitted from such a device is picked up by the antenna of the RFID chip it is transformed into electrical energy which allows the RFID chip to function, comprising the following of commands when those are simultaneously enclosed in the signal coming from the reader/interrogator (e.g. storing transmitted information in a memory when that is present, or deleting information from that memory) and sending a signal back to the reader/interrogator.

The active RFID chips have a battery on board for their energy supply. Because of that, they can actively send a signal out that can be picked up by a reading device. This also means that tags with such RFID chips can be detected at much larger distances than tags with passive RFID chips, but because of the battery the former tags can not be made as small as the latter and they also cost more.

Relatively recently an RFID inventory system at item level was described in patent application US-A-2007/019070, which is also hereby incorporated by reference. Furthermore, various applications of RFID tags in health care were described in references 1-4 in the list on page 18, which publications are also hereby incorporated by reference. For tracking biological tissue cassettes in hospital pathology departments, RFID tags attached to tissue cassettes have been described in U.S. patent applications US-A-2006/239867 and US-A-2006/031012, which are also hereby incorporated by reference.

However, in modern day pathology more and more procedures regarding tissue sample processing are speeded up by steps that involve the use of a microwave oven (e.g. tissue fixation and tissue decalcification). Since RFID tags contain an integrated circuit connected to an antenna, the electronic parts will be destroyed by the electromagnetic field in a microwave oven.

Therefore, tissue cassettes to which an RFID tag is permanently attached, or tissue cassettes in which an RFID tag has been incorporated in an inseparable way, cannot be used in tissue processing that involves the use of a microwave oven. That limitation poses a problem for the implementation of the use of such tissue cassettes and RFID technology in pathology.

Furthermore, RFID tags which are attached to the outside of tissue cassettes run the risk of being damaged when excess paraffin is scraped off the cassette after the embedding in paraffin of a processed sample of biological tissue and the tissue cassette in which the sample was processed. RFID tags attached to the outside of the long side walls of tissue cassettes also run the risk of being damaged when the tissue cassette (after said embedding and scraping off the excess paraffin) is clamped in a microtome for cutting sections of the biological tissue sample. In this respect it should be noted that the angular side of a tissue cassette, which would not be touched by the claws of the clamp in a microtome, should not be covered by attaching an RFID tag, since most pathology labs would like to use that space for a registration number or other code to enable visual recognition in case of a failure of the electronic equipment that is used to read the information in the RFID chip. These risks form problems for labeling tissue cassettes on the outside with RFID tags. Furthermore, RFID tags that would block the holes in the bottom of the tissue cassette and/or the holes in the lid that is used to close the tissue sample chamber of the tissue cassette cannot be applied, since a flow of fluids through those holes during processing of a tissue sample enclosed in the tissue sample chamber and a flow of fluid paraffin during said embedding is necessary.

When applying RFID tags which are attached to tissue cassettes with an adhesive like a glue, it is required that the adhesive can resist all the chemicals which are used in the processing of tissue samples in tissue cassettes and that after the tissue samples and the cassettes have been embedded in paraffin, the adhesive will hold for at least 100 years. Such requirements form a problem for labeling tissue cassettes with RFID tags using an adhesive like a glue.

The present invention offers a solution for these problems.

BRIEF SUMMARY OF THE INVENTION

The present invention provides a method to turn biological tissue sample cassettes into devices which are traceable with RFID technology by using a system with inlays tagged with an RFID chip which can be positioned in the tissue sample chamber of tissue cassettes for a limited period of time, or definitely. That option enables to use tissue cassettes with inlays tagged with RFID chips in all pathology tissue processing steps, with the exception of processing in an electromagnetic field in a microwave oven. During the latter processing the inlays can be temporarily removed from the cassettes. After that latter processing the inlays can be repositioned in the tissue sample chambers of the tissue cassettes and the tissue samples in those cassettes can further go through the necessary other stages of tissue processing and other situations in pathology institutes/laboratories and their archives, in which situations tracking and tracing of cassettes can be performed when the inlays tagged with RFID chips are present in the tissue sample chamber of the tissue cassettes.

The positioning of the inlays inside the cassettes also means that damage to the inlays that would happen if they were attached to the outside of the cassettes, is not an issue.

The inlays are either formed in a way that the part with the antenna of the RFID chip is running around an opening and can be positioned flat on the bottom of the tissue sample chamber of the cassette, or against the inside walls of that chamber, or is formed differently, but in all cases formed in a way that sufficient fluid paraffin can flow through the holes in the bottom of the tissue sample chamber of the tissue cassette when a tissue sample together with the tissue cassette is embedded in paraffin and preceding to that, a sufficient amount of fluid can flow through those holes and the holes in the cassette lid when said chamber is closed with said lid during the processing of a tissue sample in said chamber. Such forms of the inlay are also designed that all forms leave as much room as possible for the tissue sample positioned in the same tissue sample chamber as the inlay and they all allow the use of the inlays in different types of tissue cassettes.

In particular embodiments of the invention the inlay is either bonded with one side to a layer of polymer or other compound(s), or fully covered with such material. For such configurations, embodiments of the invention are envisaged which enable the fixation of the inlay in the tissue sample chamber without the use of additional fixation means. Such configurations also enable the design of a standard form that can be used to house different types of RFID chips and antennas, as specified for the different frequency bands used for RFID signal transmission.

Furthermore the RFID chip in the inlay is either passive or active, while in the latter case an embodiment is envisaged wherein the battery for the electric energy supply of the chip is a separate one, which is positioned outside the tissue sample chamber.

The inlay is either formed in a way that, as depicted, the antenna containing part can be placed flat on the bottom of the tissue sample chamber of a tissue cassette, or in a way that, as depicted, the antenna containing part can be placed against the inside walls of the tissue sample chamber of a tissue cassette.

In both cases the inlay and especially the antenna containing part which is either running around an opening or folded together will leave enough room to ensure that fluid paraffin or other fluid can sufficiently flow through the holes in the bottom of the tissue sample chamber of the tissue cassette in which the inlay is placed and through the holes in the cassette lid when that is used to close said chamber, sufficiently for cassette embedding respectively tissue processing.

Figure 1:
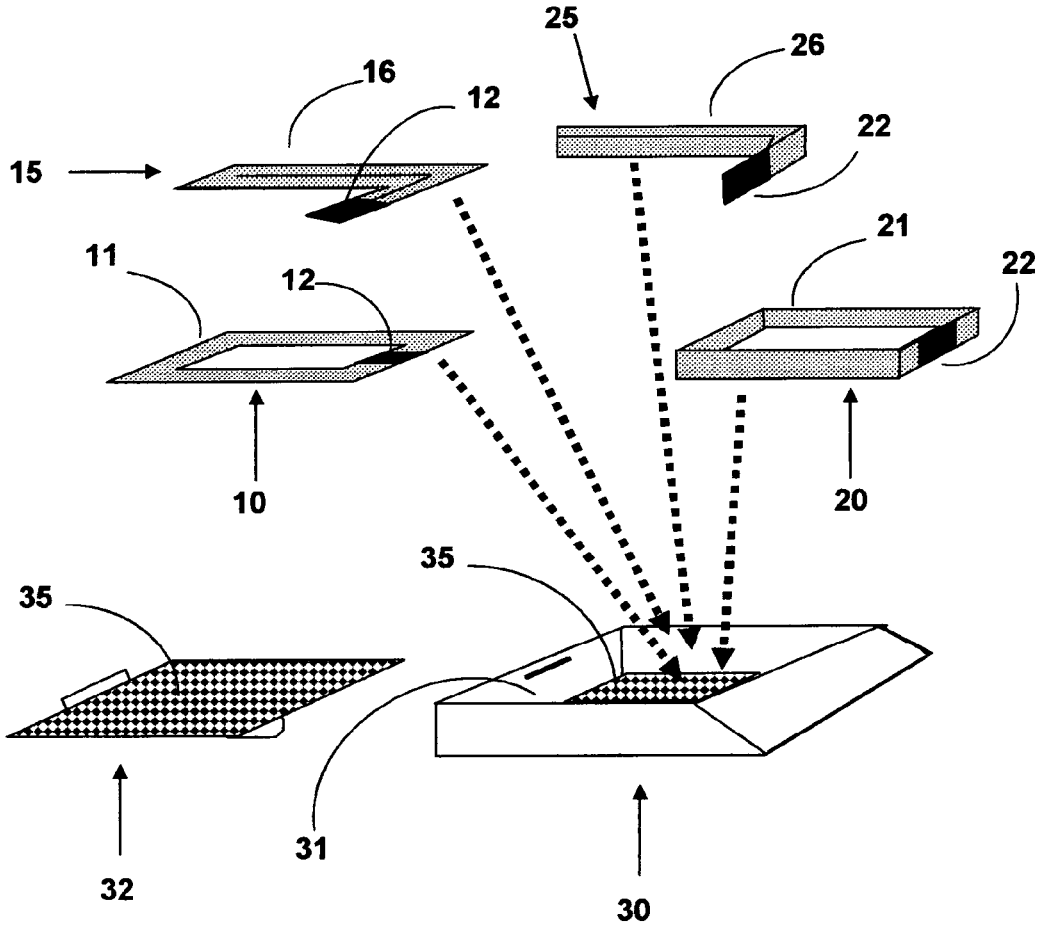
FIG. 1 is a view of a tissue cassette and a tissue cassette lid to close the partly visible tissue sample chamber, plus different forms of an inlay with an RFID chip, which has an antenna around an opening, or an antenna that is folded together.
Figure 2:
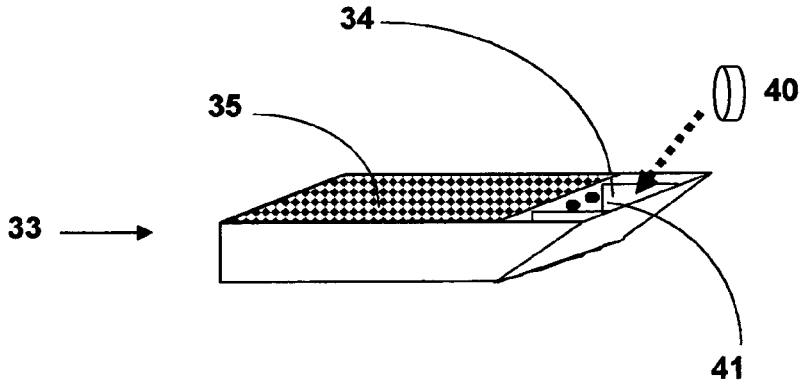

FIG. 2 is a view of a tissue cassette upside down, showing a cavity, next to the bottom of the tissue sample chamber, with room for a small battery, in case the RFID chip in the inlay displayed in FIG. 1 is an active RFID chip which receives electrical energy from a separate battery. Electrical energy is then conducted via contact points in/on the wall of the tissue sample chamber and wires to the RFID chip in the tissue sample chamber (not shown).

Figure 3:
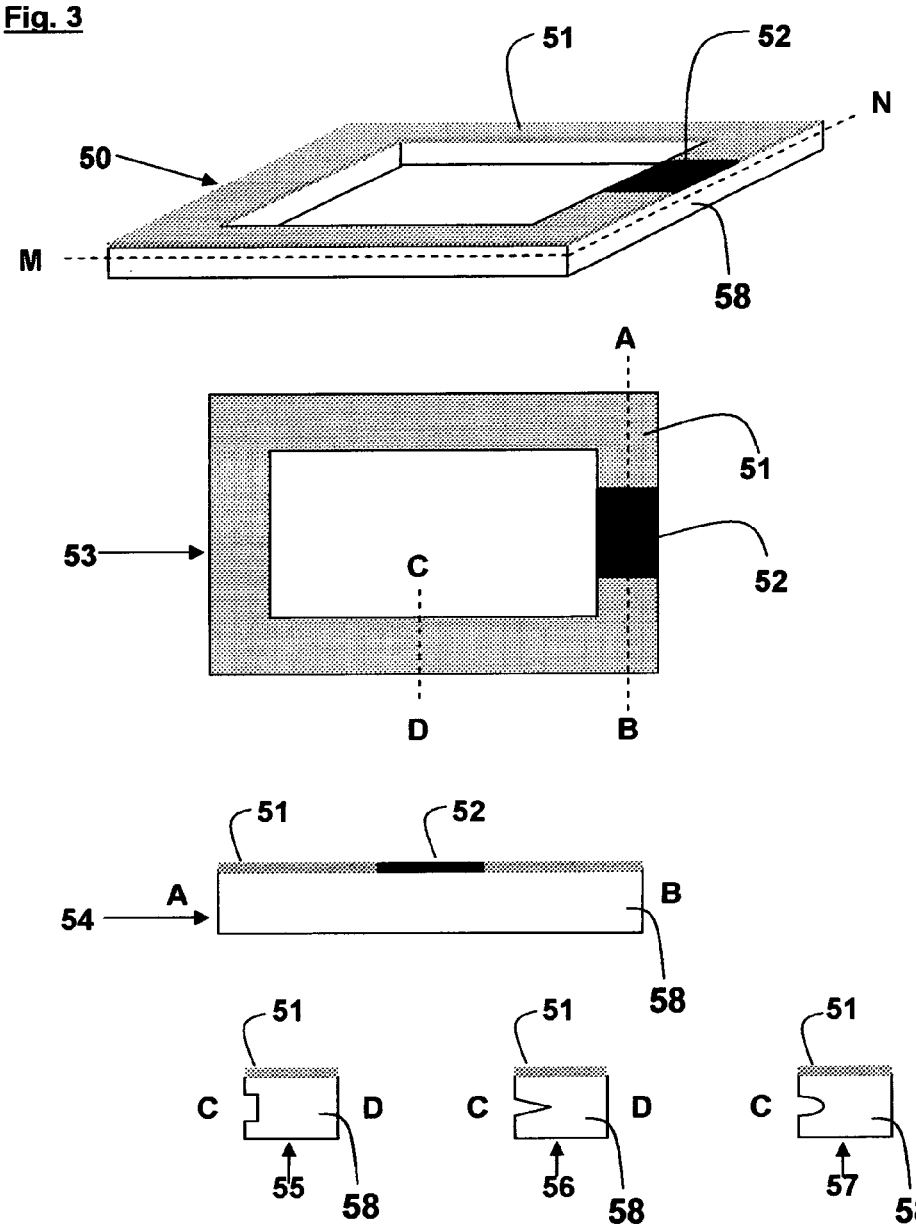

FIG. 3 is a view of a form of an inlay, seen from 2 different angles, plus cross sections of various alternative embodiments, in which the inlay on one side is bonded to a layer of a polymer (e.g. an epoxy resin), or one or more other compounds that resist deteriorating influences of the chemicals that make contact with the inlay and said layer when the inlay is positioned in the tissue sample chamber of a tissue cassette during the processing of a tissue sample that is also present in that tissue sample chamber and wherein the inlay and said layer are running around an opening.

Figure 4:
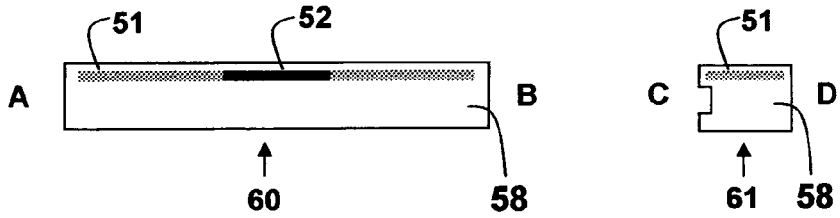

FIG. 4 is a view of 2 cross sections of an inlay like the one shown in FIG. 3, but when the RFID chip and the antenna are covered on all sides with said polymer or said other compound(s), while the material covering the inlay is at least on one side of the inlay forming a layer that is chosen to have a certain thickness with the width and height ratio of a beam or a bar when looked at the layer in cross section and with dimensions that make the covering material, plus the inlay fit in the tissue sample chamber of a tissue cassette.

Figure 5:
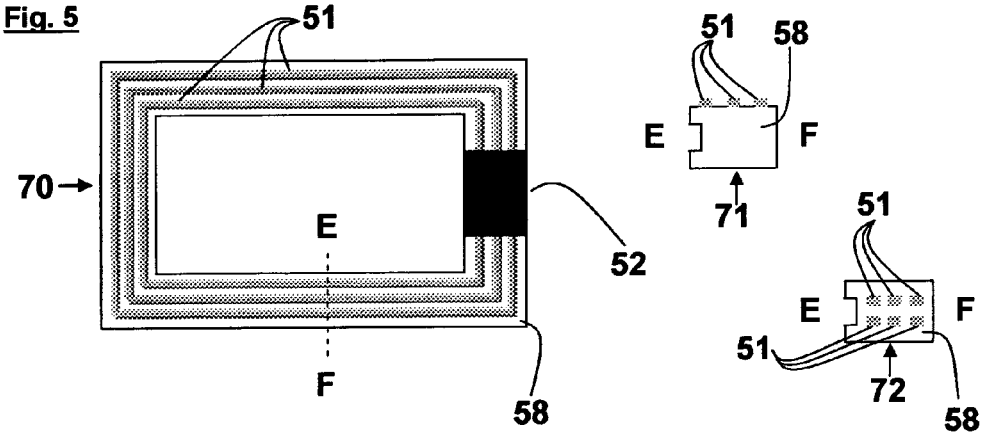

FIG. 5 is a view of an inlay like the one shown in FIG. 3, but with an antenna consisting of a coil with several loops around an opening, plus the view of 2 cross sections of various embodiments of such a configuration.

Figure 6:
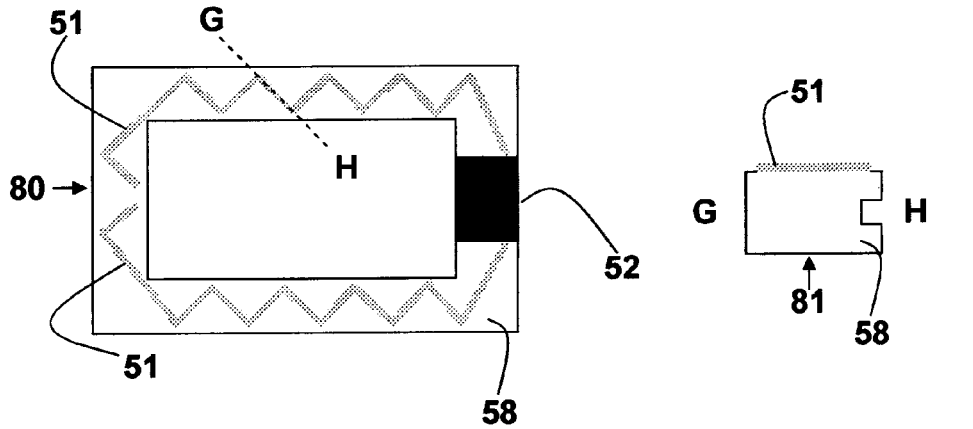

FIG. 6 is a view of an inlay like the one shown in FIG. 3, but with a bipolar antenna, plus the view of a cross section of that configuration.

Figure 7:
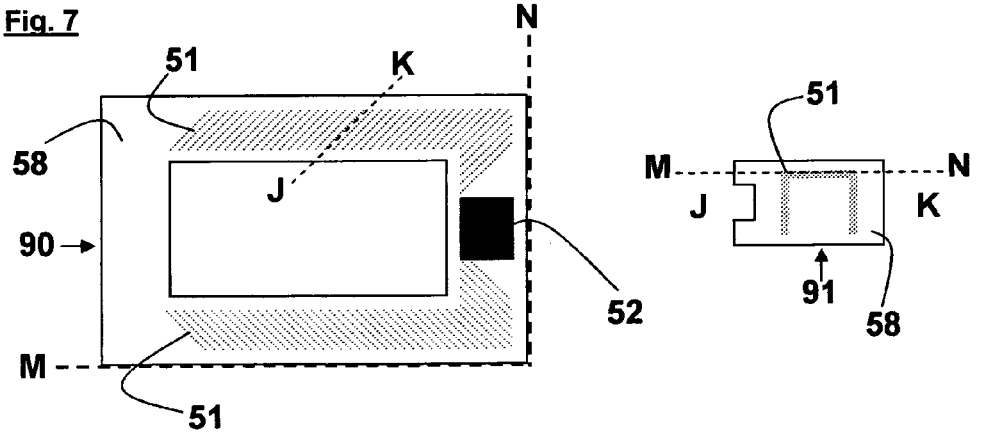

FIG. 7 is a view of 2 cross sections (along different planes) of an inlay like the one shown in FIG. 6, but wherein the antenna arms have the form of spirals and wherein the RFID chip and the antenna spirals are covered on all sides with said polymer or said other compound(s).

Figure 8:
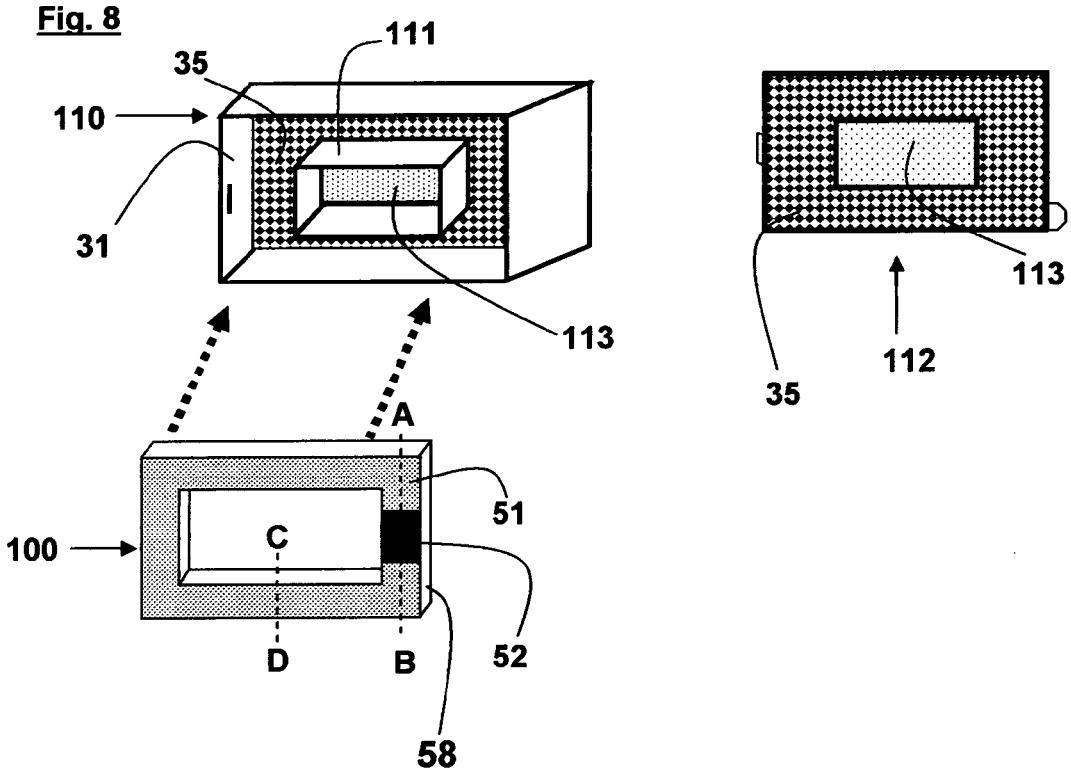

FIG. 8 is a view of a tissue cassette standing on its side, containing an inner tissue sample chamber within the tissue sample chamber and a view of a tissue cassette lid designed to close the inner tissue sample chamber, plus a view of an inlay that is also standing on its side, which is comparable to the inlay depicted in FIG. 3. The inlay is formed in a way that, as depicted, it can be placed in the tissue sample chamber and around the inner tissue sample chamber.

DETAILED DESCRIPTION OF THE INVENTION

While the present invention is susceptible of embodiment in other forms, there is shown in the drawings in FIGS. 1-8, and will hereinafter be described, various presently preferred embodiments, with the understanding that the present disclosure is to be considered as exemplifications of the invention, and is not intended to limit the invention to the specific embodiments as illustrated in the figures.

Furthermore, it should be noted that the drawings in the figures are only schematic representations and that sizes, especially in cross sections, are not exactly proportional and may be intentionally adapted for a better view.

Although for a number of years now many items in many fields have been tagged with RFID chips, the actual use of such systems in health care is not yet widespread.

As far as application in the field of pathology is concerned, patent applications were filed for tissue cassettes to which RFID tags would be permanently attached, like the above mentioned applications US-A-20061239867A1 and US-A-2006/031012, which are hereby incorporated by reference.

In order to enable the use of tissue cassettes in tissue processing steps in which a microwave oven exerts an electromagnetic field that would be destructive to the integrated circuit of RFID chips, but also to enable RFID technology in other tissue processing steps and other pathology situations than those that involve electromagnetic fields in micro wave ovens, in the present invention a separate inlay tagged with an RFID chip is designed that can be positioned at a suitable moment in the tissue sample chamber of tissue cassettes and stay in said chamber indefinitely, or for one or more limited periods of time. For the time of the processing of tissue samples in tissue sample chambers of tissue cassettes which involves electromagnetic fields in micro wave ovens, the inlay can be removed from said chamber and later the inlay can be re-positioned in said chamber, when so desired. The possibility to remove the inlay from said sample chamber it is positioned in, means that the inlay can be used in more than one tissue cassette, especially when the inlay has an RFID chip of a type that allows to send information to the chip which is stored in the memory of the chip, later delete that information from the memory and then send new information to the RFID chip, which is also stored in the memory of the chip.

An inlay designed to be used in the tissue sample chamber of tissue cassettes does not have the risk of the RFID chip and/or its antenna being damaged when excess paraffin is scraped off the outside of the tissue cassette after the embedding in paraffin, nor the risk of the RFID chip and/or its antenna being damaged when the cassette is clamped in a microtome.

Furthermore, in the various embodiments of the invention the inlay is designed in a way that the maximally possible amount of room in the tissue sample chamber is left for a tissue sample when such an inlay is positioned in the tissue sample chamber and in a way that the flow of fluids through the holes in the bottom of the tissue cassette and the lid of the tissue cassette is as close to maximal flow as possible.

Furthermore, in particular embodiments of the invention the inlay is designed in a way that it is bonded on one side to a layer of material that is shaped in a way that when the inlay is positioned in the tissue sample chamber of a tissue cassette, the inlay is fixated in the tissue sample chamber, without the use of any additional fixation means like glue or clamps, when the tissue cassette is embedded in paraffin. An inlay that is fixated in the tissue sample chamber of a tissue cassette by the paraffin used for the embedding of the cassette does not need an adhesive that can resist the chemicals used in the processing of tissue samples and can hold for at least 100 years.

In comparable particular embodiments of the invention the inlay is completely covered with said material, whereas in those particular embodiments and comparable particular embodiments the shape and dimensions of said material allow that various types and forms of RFID chips and antennas can be used in the bonded or covered inlay.

Furthermore, in the various embodiments of the invention the inlay is designed in a way that it not only fits in tissue cassettes with one tissue sample chamber, but also in tissue cassettes with an inner tissue sample chamber, because in the latter case the inlay fits between the wall of the tissue sample chamber and the wall of the inner tissue sample chamber.

In the embodiment of the invention as depicted in FIG. 1 and FIG. 2 there is an inlay 10, or 15, or 20, or 25 tagged with an RFID chip in inlay part 12 respectively 22, which has an antenna in inlay part 11, respectively 16, 21, or 26 and wherein the inlay is formed either in a way that the inlay 10 or 15 can be placed flat on the bottom of the tissue sample chamber 31 of a tissue cassette 30 that can be closed with a cassette lid 32, or in a way that the inlay 20 or 25 can be placed against the inside of the walls of the tissue sample chamber 31 of a tissue cassette 30 that can be closed with a cassette lid 32.

In the embodiment depicted in FIG. 1 the part of the two forms of the inlay with the antenna, which are numbered 10 and 20, is running around a central opening. In other embodiments, other configurations of the inlay and especially the part with the antenna can be envisaged, for example the inlay configurations numbered 15 and 25 in which the respective antenna containing parts 16 and 26 are folded together, as long as the inlay allows a flow of fluid paraffin or other fluid as close to maximal flow as possible through the holes 35 in the bottom of a cassette like the tissue cassette 30 and through the holes 35 in a cassette lid like the cassette lid 32, when the tissue sample chamber 31 is closed with the lid 32.

In a particular embodiment of the invention, the inlay 10 or 20 including the part 12 respectively 22 with an RFID chip and the part 11 respectively 21 with the antenna is covered with a polymer (e.g. an epoxy resin), or one or more other compounds, to resist deteriorating influences of chemicals that make contact with the inlay, when a tissue sample is processed in the tissue sample chamber 31 of the tissue cassette 30 that is closed with a cassette lid 32, or the remains of such chemicals that stay behind in the tissue sample chamber 31 after the tissue sample processing has taken place.

In another particular embodiment of the invention the RFID tag does not comprise a simple chip that can only hold a fixed number in the form of a limited number of bits, but an RFID tag with an integrated circuit that has a memory capacity of several kilobytes. That means that data up to such an amount of bytes can be uploaded wirelessly from a transmitting device as they are know to those skilled in the art, via radio waves or other media into such an RFID chip. These transmitting devices can also be used as an interrogator or reader in order to detect and track RFID tags and read and/or retrieve and/or delete the data which are present in the RFID chips.

To accommodate for the various requirements of various systems that can communicate with RFID chips, which use different frequencies for the transmission of signals to and from the RFID chips, various inlays are envisaged, each with a type of RFID chip and antenna suitable for one or more specific systems operating at a specific frequency band, which are divided in LF, MF, HF, VHF, UHF and SHF frequencies (in which the acronyms stand for respectively Low Frequency, Medium Frequency, High Frequency, Very High Frequency, Ultra High Frequency and Super High Frequency). Different systems operating with different signals using different frequency bands require different types of antennas, ranging from antennas consisting of a coil with one or more loops, to bipolar antennas with arms that can be straight or folded (e.g. in a zigzag form) or in the form of a spiral. Those skilled in the art know for which applications and under which circumstances a specific combination of a type of RFID chip with a certain antenna type and the necessary equipment is required for the communication with the RFID chip.

In yet another embodiment of the invention the inlay is containing an active RFID tag (not shown in the figures), while the battery to provide the electrical energy for such an RFID chip is not positioned inside the tissue sample chamber 31, but is a separate battery 40 that is placed in the tissue cassette cavity 34 that is made visible in FIG. 2, where the tissue cassette is depicted in the upside down position 33. For this embodiment it can be envisaged that the tissue cassette cavity 34 is adapted, as well as the type of battery, in order to come to a suitable configuration in which the electrical energy that is necessary for the functioning of the active RFID tag is conducted from the battery in the tissue cassette cavity 34, via contact points 41 and electrical wires (not shown in the figures) to the active RFID chip positioned in the tissue sample chamber 31. In such a suitable configuration a different position can be envisaged of the contact points 41 in the tissue cassette cavity 34 than is now depicted in FIG. 2.

In the embodiment of the invention as depicted in FIG. 3 there is an inlay 50, tagged with an RFID chip in inlay part 52, and its antenna in inlay part 51. The inlay is bonded to a layer 58 consisting of a polymer (e.g. an epoxy resin), or one or more other compounds that resist deteriorating influences of the chemicals that make contact with the inlay when the inlay is positioned in the tissue sample chamber of a tissue cassette during the processing of a tissue sample that is also present in that tissue sample chamber. In this particular embodiment the layer of said polymer or said other compound(s) has the form of a rectangular frame with dimensions that make such an inlay, plus said layer, fit in the tissue sample chamber of a tissue cassette while positioned as much as possible against the inner wall of the tissue sample chamber, thereby leaving an amount of room for a tissue sample in that tissue sample chamber that is as close to the maximal amount as possible and a flow for fluids through the holes in the bottom of the cassette and in the cassette lid that is as close to the maximal flow as possible.

Said layer of said polymer or said other compound(s) is chosen to have a certain thickness with the width and height ratio of a beam or a bar when looked at in cross section. In FIG. 3 said layer follows the form of the inlay, a rectangular frame around an opening, while in other embodiments of the invention (not shown) the inlay and the layer to which it is bonded can have the form of a straight beam or bar, or an L-shaped or U-shaped beam or bar. Also in those embodiments the inlay plus the layer to which it is bonded have dimensions to fit in the tissue sample chamber of a tissue cassette. In those embodiments wherein said layer has another form than a rectangular frame, the form of the RFID chip and its antenna is adapted accordingly.

In a particular embodiment (not shown) the thickness of said layer bonded to the inlay is chosen in such a way that it is possible to position the inlay bonded on top of said layer in such a way in the tissue sample chamber of a tissue cassette, that the inlay is just not covered with paraffin when the tissue cassette is embedded in paraffin. Such a configuration ensures that the transmission of signals to and from the RFID chip is possible without being hampered by material(s) covering the antenna of the RFID chip.

In FIG. 3 there is also an inlay 53, which is depicted as a top view of inlay 50, also containing part 52 with the RFID chip and part 51 with the antenna.

Furthermore, there is in FIG. 3 also a cross section 54 with sides A and B, which is a cross section of inlay 53 and layer 58 along the line A-B as indicated. This cross section is also depicting part 52 with the RFID chip and part 51 with the antenna.

Furthermore, there are in FIG. 3 the cross sections 55, 56 and 57, each with sides C and D, which are cross sections of inlay 53 and layer 58 along the indicated line C-D, depicting various shapes of various embodiments of the inlay 53. The cross sections 55, 56 and 57 also depict the part 51 with the antenna and they furthermore show that embodiments of the inlay are envisaged in which a groove, slot or notch with a suitable shape is formed on the inside of the layer of material to which inlays like inlay 53 or 50 are bonded. Such a groove, slot or notch has a suitable shape if such an inlay is positioned in the sample chamber of the tissue cassette at the time the tissue sample and the tissue cassette are embedded in paraffin and the groove, slot or notch will fill with a sufficient amount of fluid paraffin. The amount of paraffin is sufficient if the inlay is fixated in the tissue sample chamber when the paraffin has solidified. That result means that for such inlays no additional fixation means like glue or clamps are needed for keeping the inlay with the RFID tag in place when the embedded cassette is archived together with the embedded tissue sample for up to 100 years or more. Removal of the inlay will then only be possible after melting the paraffin.

In the embodiment of the invention as depicted in FIG. 4 there is an inlay which is covered on all sides with said polymer or said other component(s) and the material covering the inlay is on one side of the inlay forming a layer, which in this particular embodiment is chosen to have the thickness of a beam or a bar with dimensions that make such an inlay, plus the covering material, fit in the tissue sample chamber of a tissue cassette. A cross section 60 with sides A and B of such an inlay and layer 58 is shown in FIG. 4, which is comparable to the cross section 54, also containing part 52 with the RFID chip and part 51 with the antenna.

Furthermore, in FIG. 4 there is a cross section 61 with sides C and D, comparable to cross section 55, also depicting part 51 with the antenna, but in which the antenna is covered on all sides with said polymer or said other component(s) and the material covering the inlay is on one side of the inlay forming a layer 58, which in this particular embodiment is chosen to have the thickness of a beam or a bar with dimensions that make such an inlay, plus the covering material, fit in the tissue sample chamber of a tissue cassette.

In a particular embodiment (not shown) the material covering the inlay is formed in such a way that it is possible to position the inlay in the tissue sample chamber of a tissue cassette in such a way, that the inlay is just not covered with paraffin when the tissue cassette is embedded in paraffin. Such a configuration ensures that the transmission of signals to and from the RFID chip is the least hampered by material(s) covering the antenna of the RFID chip.

In the embodiment of the invention as depicted in FIG. 5 there is an inlay 70, shown as a top view, which is bonded to a layer 58 of a polymer (e.g. an epoxy resin), or one or more other compounds that resist deteriorating influences of the chemicals that make contact with the inlay and the layer when they are positioned in the tissue sample chamber of a tissue cassette during the processing of a tissue sample that is also present in that tissue sample chamber. The inlay is comparable to inlays 53 and 50, also containing part 52 with the RFID chip, but wherein the antenna containing part 51 contains an antenna in the form of a coil with several loops to enable a strong electromagnetic coupling with the antenna of the equipment that is used to read and/or write information on/to the RFID chip and to enable the equipment to send and/or receive a signal with information to and/or from the RFID chip while the distance at which signal transmission is possible is maximized. Furthermore, in FIG. 5 the cross section 71 is depicted, with the sides E and F, which is a cross section of inlay 70 and layer 58 along the line E-F, also depicting part 51 with the antenna. Furthermore, in FIG. 5 the cross section 72 is depicted, which is comparable to cross section 71, but showing an embodiment in which part 52 with the RFID chip (not shown) and part 51 with the antenna and a number of loops in the antenna coil are covered on all sides with said polymer or said other component(s). In this particular embodiment the material covering the inlay is on one side of the inlay forming a layer 58, which is chosen to have the thickness of a beam or a bar with dimensions that make such an inlay and the covering material fit in the tissue sample chamber of a tissue cassette.

In the embodiment of the invention as depicted in FIG. 6 there is an inlay 80 bonded to a layer 58 of a polymer (e.g. an epoxy resin), or one or more other compounds that resist deteriorating influences of the chemicals that make contact with the inlay when the inlay is positioned in the tissue sample chamber of a tissue cassette during the processing of a tissue sample that is also present in that tissue sample chamber. The inlay is comparable to inlays 53 and 50, also containing part 52 with the RFID chip, but wherein the antenna in the antenna containing part 51 contains a bipolar antenna and the necessary length of the antenna is reached by folding the arms of the antenna in a zigzag form. Alternatively the folding of the arms of the antenna can be in another way around the opening of the layer 58. Furthermore, in FIG. 6 there is a cross section 81, with sides G and H, which is a cross section of the inlay 80 and layer 58 along the line G-H, also depicting part 51 with the antenna.

In the embodiment of the invention as depicted in FIG. 7 there is an inlay 90, shown as a cross section that is a cross section of inlay 50 along the horizontal plane through layer 58 defined by the lines M and N in FIG. 3. The inlay is also containing part 52 with the RFID chip, but the antenna in the antenna containing part 51 is bipolar. The necessary length of the antenna is reached by forming the antenna arms into spirals to enhance said electromagnetic coupling, while part 52 with the RFID chip and part 51 with the antenna are enclosed in said layer of polymer, or said other component(s), of which the layer 58 is running around an opening.

Furthermore, in FIG. 7 there is a cross section 91, with sides J and K, also depicting part 51 with the antenna and layer 58, which is a cross section of the inlay along the line J-K indicated in cross section 90. In the cross section 91 the level of the plane defined by the lines M and N in FIG. 3 is indicated and it should be noted that in this particular embodiment the spiraling antenna is existing as a square or rectangular spiral and that because of the pitch of the spiral a full square or rectangle is not visible in cross section 91.

In the embodiment of the invention as depicted in FIG. 8 there is an inlay 100, tagged with an RFID chip in inlay part 51, which has an antenna in inlay part 52. The inlay 100, standing on its side, is bonded to a layer 58 of a polymer (e.g. an epoxy resin), or one or more other compounds that resist deteriorating influences of the chemicals that make contact with the inlay when the inlay is positioned in the tissue sample chamber of a tissue cassette during the processing of a tissue sample that is also present in that tissue sample chamber. The inlay is comparable to the inlays 50 and 53 depicted in FIG. 3.

Furthermore, in FIG. 8 there is a tissue cassette 110 (standing on its side) containing an inner tissue sample chamber 111 within the tissue sample chamber 31 and there is a top view of a tissue cassette lid 112. The bottom of the inner tissue sample chamber 111 and the part of the tissue cassette lid 112 that is used to close the inner tissue sample chamber 111 both have small holes 113. The small holes 113 are much smaller than the holes 35 in the rest of the bottom of the tissue sample chamber 31 and the cassette lid 112. As was described above in FIGS. 1 and 2 for the holes 35 in the bottom of tissue cassettes 30 and 33 and in the tissue cassette lid 32, also through the small holes 113 the fluids used during the processing of tissue samples can flow in and out the inner tissue sample chamber 111. Such tissue cassettes and lids as the tissue cassette 110 and tissue cassette lid 112 are used for processing tissue samples in the inner tissue sample chamber 111 when the tissue samples are biopsies which are so small that they might escape through the wholes present in the whole bottom and lid of tissue cassettes like those depicted in FIGS. 1 and 2. The inlay 100 and the layer 58 are formed in a way that the central opening enables the inlay and said layer to fit in the tissue sample chamber 31 of the tissue cassette 110, around the inner tissue sample chamber 111.

LIST OF REFERENCE NUMERALS REGARDING FIGS. 1-8

10=Inlay tagged with RFID chip and antenna around opening
11=Inlay part with antenna around opening
12=Inlay part with RFID chip
15=Inlay tagged with RFID chip and antenna folded together
16=Inlay part with antenna folded together
20=Inlay tagged with RFID chip and antenna around opening
21=Inlay part with antenna around opening
22=Inlay part with RFID chip
25=Inlay tagged with RFID chip and antenna folded together
26=Inlay part with antenna folded together
30=Tissue cassette
31=Tissue sample chamber
32=Tissue cassette lid
33=Tissue cassette upside down
34=Tissue cassette cavity
35=Holes in tissue cassette bottom and tissue cassette lid
40=Battery
41=Contact points
50=Inlay tagged with RFID chip and antenna, bonded to layer of polymer or other compound(s), which has an opening
51=Inlay part with antenna
52=Inlay part with RFID chip
53=Top view of inlay
54=Cross section of inlay, bonded to layer of polymer or other compound(s)
55=Cross section of inlay, bonded to layer of polymer or other compound(s)
56=Cross section of inlay, bonded to layer of polymer or other compound(s)
57=Cross section of inlay, bonded to layer of polymer or other compound(s)
58=Layer of polymer or other compound(s)
60=Cross section of inlay, bonded to layer of polymer or other compound(s)
61=Cross section of inlay, covered with polymer or other compound(s)
70=Top view of inlay, bonded to layer of polymer or other compound(s), which has an opening
71=Cross section of inlay, bonded to layer of polymer or other compound(s)
72=Cross section of inlay, covered with polymer or other compound(s)
80=Top view of inlay, bonded to layer of polymer or other compound(s), which has an opening
81=Cross section of inlay, bonded to layer of polymer or other compound(s)
90=Cross section of inlay, covered with layer of polymer or other compound(s), which has an opening
91=Cross section of inlay, covered with polymer or other compound(s)
100=Inlay tagged with RFID chip and antenna, bonded to layer of polymer or other compound(s), which has an opening
110=Tissue cassette with inner tissue sample chamber
111=Inner tissue sample chamber
112=Tissue cassette lid
113=Small holes in bottom of inner tissue sample chamber and in part of tissue cassette lid
⇢ =Positioning of an inlay or a battery in the tissue sample chamber, respectively the tissue cassette cavity.

REFERENCES

1. Kumar S, Swanson E, Tran T. RFID in the healthcare supply chain: usage and application. Int J Health Care Qual Assur. 2009; 22(1):67-81.
2. Iadanza E, Dori F, Miniati R, Bonaiuti R. Patients tracking and identifying inside hospital: a multilayer method to plan an RFId solution. Conf Proc IEEE Eng Med Biol Soc. 2008; 2008:1462-5.
3. Kim D S, Kim J, Kim S H, Yoo S K. Design of RFID based the Patient Management and Tracking System in hospital. Conf Proc IEEE Eng Med Biol Soc. 2008; 2008:1459-61.
4. as Florentino G H, Paz de Araujo C A, Bezerra H U, Junior H B, Xavier M A, de Souza V S, de M Valentim R A, Morais A H, Guerreiro A M, Brandao G B. Hospital automation system RFID-based: technology embedded in smart devices (cards, tags and bracelets). Conf Proc IEEE Eng Med Biol Soc. 2008; 2008:1455-8.

The invention claimed is:

1. A method to turn a cassette (30, 110) for biological tissue samples, containing a tissue sample chamber (31, 111), which can be closed with a tissue cassette lid (32, 112), into a device traceable with RFID technology, comprising the steps of:

providing an inlay (10, 15, 20, 25, 50, 100) tagged with an RFID chip, wherein the inlay (10, 15, 20, 25, 50, 100) contains the RFID chip in an inlay part (12, 22, 52) and an antenna in another inlay part (11, 16, 21, 26, 51);

bonding the inlay (10, 15, 20, 25, 50, 100) to a layer (58) consisting of one or more compounds able to resist the chemicals used during processing of a biological sample in the tissue sample chamber (31, 111), wherein the inlay (10, 15, 20, 25, 50, 100) has a form of one of: a frame around a central opening (10, 30, 50, 100); a straight frame; an L-shaped frame; and an U-shaped frame; and placing the inlay in the tissue sample chamber of the tissue cassette, wherein the inlay allows a flow of one or more fluids through holes in a bottom and the lid (32, 112) of the tissue sample cassette (30, 110), and wherein the flow is sufficient for biological tissue processing and for embedding of the tissue sample cassette together with the biological tissue sample in paraffin.

2. The method according to claim 1, wherein the dimensions of the inlay (10, 15, 20, 25, 50, 100) and the bonded layer (58) are configured so that the inlay is fixated in the tissue sample chamber without any additional fixation means when the tissue sample cassette is embedded in paraffin.

3. The method according to claim 1, wherein the layer (58) has a groove or slot which is suitable for filling with paraffin.

4. The method according to claim 3, wherein the inlay has a form of a frame, and the groove or slot is situated around the central opening.

5. The method according to claim 1, wherein the inlay is completely covered with the layer (58).

6. The method according to claim 1, wherein the antenna containing part (51) contains an antenna in the form of a coil with one or more loops.

7. The method according to claim 6, wherein said inlay is in the form of a frame, and said antenna containing part (51) contains the antenna in the form of a coil with one or more loops around the central opening.

8. The method according to claim 1, wherein the inlay has a form of a frame, wherein the antenna containing part (51) contains a bipolar antenna, wherein the arms of the antenna are folded around the central opening.

9. The method according to claim 8 wherein the antenna is provided in one of a zig-zag form and a spiral form.

10. The method according to claim 1, wherein the RFID chip is of an active type.

11. The method according to claim 10, wherein a battery (40) to supply electrical energy for the RFID chip is not on board the chip, but is a separate battery that is inserted in a tissue cassette cavity (34) under an angular part of the tissue cassette (33) in a way that the battery makes contact with contact points (41) in said cavity (34), which are connected to electrical wires through the wall of the tissue sample chamber, along which the electrical energy is conducted to the active RFID chip when it is positioned in said chamber.

12. The method according to claim 1, wherein the RFID chip and antenna are suitable for one or more specific systems operating at a specific frequency band chosen from LF, MF, HF, VHF, UHF and SHF frequencies.

13. The method according to claim 1, wherein the layer (58) consists of a polymer.

* * * * *